US006345524B1

(12) United States Patent
Fischer

(10) Patent No.: US 6,345,524 B1
(45) Date of Patent: Feb. 12, 2002

(54) ROTATABLE HEAD ASSEMBLY FOR SHEET METAL COIL STRAIGHTENER DEVICE

(75) Inventor: Herbert J. Fischer, Imperial, MO (US)

(73) Assignee: Engel Industries, Inc., St. Louis, MO (US)

( * ) Notice: Subject to any disclaimer, the term of this patent is extended or adjusted under 35 U.S.C. 154(b) by 0 days.

(21) Appl. No.: 09/653,269

(22) Filed: Aug. 31, 2000

(51) Int. Cl.[7] ..... B21D 3/02
(52) U.S. Cl. ..... 72/164; 72/183
(58) Field of Search ..... 72/183, 164, 162, 72/160

(56) References Cited

U.S. PATENT DOCUMENTS

| | | | | | |
|---|---|---|---|---|---|
| 2,280,564 | A | * | 4/1942 | Wilson | 72/183 |
| 3,326,026 | A | * | 6/1967 | Guillot | 72/164 |
| 3,834,204 | A | * | 9/1974 | Ihle | 72/183 |
| 4,823,582 | A | * | 4/1989 | Bourbon | 72/183 |

FOREIGN PATENT DOCUMENTS

| | | | | |
|---|---|---|---|---|
| FR | 581830 | * | 12/1924 | 72/160 |
| JP | 5-84504 | * | 4/1993 | 72/160 |

OTHER PUBLICATIONS

Galaxie Corporation, Levelers & Straighteners, (website—www.galcorp.com).
Colt Automation Limited, Cradle Straightener Combination, (website—www.coltauto.com).
Engel Industries, Unitized Compact II Coiline Front End, Sheet Metal Fabrication.
E. Paul Degarmo et al., Straightening, Materials and Processes in Manufacturing Eighth Edition, p. 517, Section 19.3.
Thomas Register 1998, Coil Handling & Feeding Equipment, p. COI//8390.
Thomas Register 1998, Coil Handling & Feeding Equipment, p. COI/8388.

* cited by examiner

*Primary Examiner*—Daniel C. Crane
(74) *Attorney, Agent, or Firm*—Blackwell Sanders Peper Martin

(57) ABSTRACT

A straightener device for substantially removing the "coil set" from a sheet of coiled material including a base frame assembly and a head assembly rotatably mounted thereto, the head assembly including a pair of feed rollers and an idler roller, the pair of feed rollers being positioned relative to each other for receiving the sheet material therebetween, the idler roller being positioned adjacent the feed rollers so as to engage the sheet material as the sheet material passes between the feed rollers, and the head assembly being rotatable about an axis of rotation such that the direction of travel of the sheet material as it exits the head assembly can be varied relative to a horizontal plane. At least one of the feed rollers is selectively adjustable relative to the other feed roller so as to vary the space therebetween depending upon the thickness of the sheet material, and the idler roller is selectively positionable relative to the feed rollers. The present head assembly can therefore be easily rotated to vary the direction of travel of the straightened sheet material as such sheet material exits the head assembly including a direction of travel which will be substantially parallel to a horizontal plane in order to accommodate other manufacturing processes.

25 Claims, 5 Drawing Sheets

ROTATABLE HEAD ASSEMBLY FOR SHEET METAL COIL STRAIGHTENER DEVICE

TECHNICAL FIELD

This invention relates generally to sheet metal coil straightener devices and, more particularly, to an improved straightener mechanism wherein the head assembly containing the feed and straightening rollers is rotatably adjustable to substantially remove the "coil set" associated with coiled stock material and to orient the sheet material so as to exit the head assembly in any desired direction of travel including a substantially horizontal direction parallel to the ground regardless of whether the coiled material is over fed or under fed into the straightener device. The present rotatable feature substantially reduces the total number of straightener rollers necessary to accomplish the straightening task and substantially reduces the power requirements associated therewith.

BACKGROUND ART

Sheet metal coil straightener devices for substantially eliminating and removing "coil set" from a coiled stock of sheet material prior to performing other fabrication and/or manufacturing operations are well known in the industry. When sheet metal or other types of sheet material are stored in coiled form, such material becomes set or imprinted with the coiled shape such that, when the material is uncoiled, it will not obtain a substantially straight, horizontally flat configuration. Instead, the coiled sheet material retains the memory of the coiled shape and will have, among other deformations, a curl associated therewith. As a result, if the coiled sheet material is merely uncoiled without passing such material through some type of straightening device, such material will not lay flat and will project downward if overwound or upward if underwound from the coil. This deformation or coil imprint is typically referred to as "coil set". Passing coiled sheet material through a straightener device substantially removes the "coil set" from the rolled material and prepares the sheet material for other machine or fabrication operations.

FIG. 1 is a schematic representation of a typical prior art sheet metal coil straightener device 10 configured for straightening over fed or overwound coils of sheet metal material, that is, it is configured to accept sheet material pulled off of the top of the coil for entry into the straightener device. The prior art straightener device 10 typically includes a pair of entry feed rollers 12, an optional pair of exit feed rollers 14, and a plurality of staggered straightening rollers 16 positioned therebetween. For over fed or overwound coils, the straightening rollers 16 are typically arranged in a pyramid-type fashion as illustrated in FIG. 1 wherein, in the particular illustration depicted in FIG. 1, two upper straightening rollers 16 are positioned above and in the space between three lower straightening rollers. In this regard, depending upon the size and thickness of the coiled material, any plurality of straightening rollers 16 may be utilized including more or less than the number of rollers 16 depicted in FIG. 1 in order to substantially remove the "coil set" from a particular stock of coiled material. Typically, the upper rollers associated with both the entry and exit feed rollers 12 and 14 are adjustable relative to the other entry and exit feed rollers to accommodate the particular thickness of the sheet material and the straightening rollers 16 are spaced and positioned so as to allow the sheet material to leave the exit feed rollers 14 in a direction of travel which is substantially parallel to a horizontal plane.

In similar fashion, FIG. 2 is a schematic representation of a typical prior art sheet metal coil straightener device 20 configured for straightening under fed or underwound coils of sheet metal material, that is, it is configured to accept sheet material pulled off of the bottom of the coil for entry into the straightener device. Like the device 10, the prior art straightener device 20 typically includes a pair of entry feed rollers 12, an optional pair of exit feed rollers 14, and a plurality of straightening rollers 16 positioned therebetween, the number and configuration of the straightening rollers 16 associated with the device 20 being somewhat different from the roller configuration associated with straightener device 10 illustrated in FIG. 1. In this regard, since the coiled sheet metal material is being pulled off of the bottom of the coil, the leading edge curl associated with the coiled sheet material will be opposite that associated with an over fed coil and, as a result, the plurality of straightening rollers 16 are offset and staggered somewhat differently as shown in FIG. 2 so as to yield a substantially straight and horizontally flat piece of sheet material when such material leaves the exit feed rollers 14. Since the leading edge curl associated with an overwound coil is different from an underwound coil, the arrangement of the straightening rollers 16 is different as illustrated in FIGS. 1 and 2 to accommodate the direction of such curl.

Due to the construction and operation of prior art straightener devices such as the devices 10 and 20 illustrated in FIGS. 1 and 2, a plurality of straightening rollers 16 including up to as many as twenty-one individual rollers 16 may be necessary in order to substantially remove the "coil set" associated with a particular sheet of coiled material. As the number of straightening rollers 16 increases, so does the complexity, size and cost of the straightener device. Also, as is evident from the roller configurations and arrangements depicted in FIGS. 1 and 2, adjustment of the straightening rollers 16 must be accomplished each time a particular straightener device transititions between the two different coil feed modes of operation, namely, from an overwound coil mode of operation to an underwound coil mode of operation, or vice versa.

It is therefore desirable to reduce the number of straightening rollers 16 associated with a particular straightener device; it is desirable to make a particular straightener device more adaptable to accommodate the reception of both overwound and underwound coils; it is desirable to reduce the overall cost of a particular straightener device; and it is desirable to improve the overall operation and efficiency of a particular straightener device.

Accordingly, the present invention is directed to overcoming one or more of the problems as set forth above.

DISCLOSURE OF THE INVENTION

In one aspect of the present invention there is disclosed a sheet metal coil straightener device having a pair of entry feed rollers and a single straightening roller mounted to a head assembly, the head assembly being rotatable or tiltable in both a clockwise and counter-clockwise direction so as to properly angularly orient the feed and straightening rollers to accommodate the reception of both overwound and underwound coils. The present invention includes means for adjusting the spacing between the pair of entry feed rollers; means for adjusting the vertical position of the straightening roller relative to the entry feed rollers; and means for rotating the entire head assembly about a predetermined axis of rotation.

Rotation of the present head assembly enables an operator to properly orient the feed and straightening rollers such that the sheet of coiled material will exit the head assembly in any desired direction of travel depending upon the subsequent maching and fabrication operations including a substantially horizontal direction parallel to ground level. The present invention eliminates the need for utilizing a plurality of straightening rollers; it reduces the size and complexity of the overall straightener device; and it greatly reduces the power requirements for rotating the feed and straightening rollers and for accomplishing the straightening process.

These and other aspects and advantages of the present invention will become apparent to those skilled in the art after considering the following detailed description in connection with the accompanying drawings.

BRIEF DESCRIPTION OF THE DRAWINGS

For a better understanding of the present invention, reference may be made to the accompanying drawings in which.

BEST MODE FOR CARRYING OUT THE INVENTION

Figure 3:
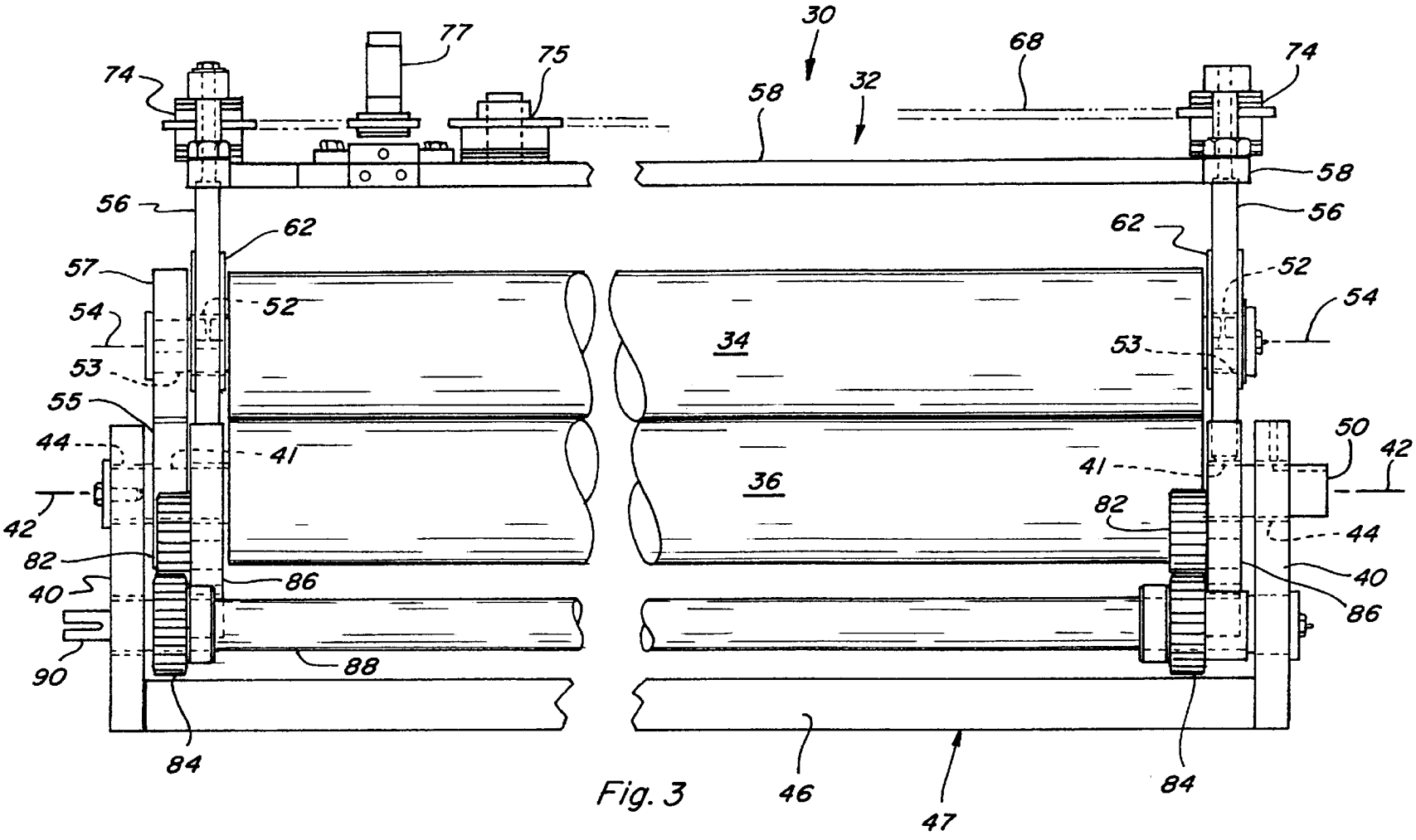
FIG. 3 is a front elevational view of the present rotatable head assembly rotatably mounted to a base frame assembly.
Figure 4:
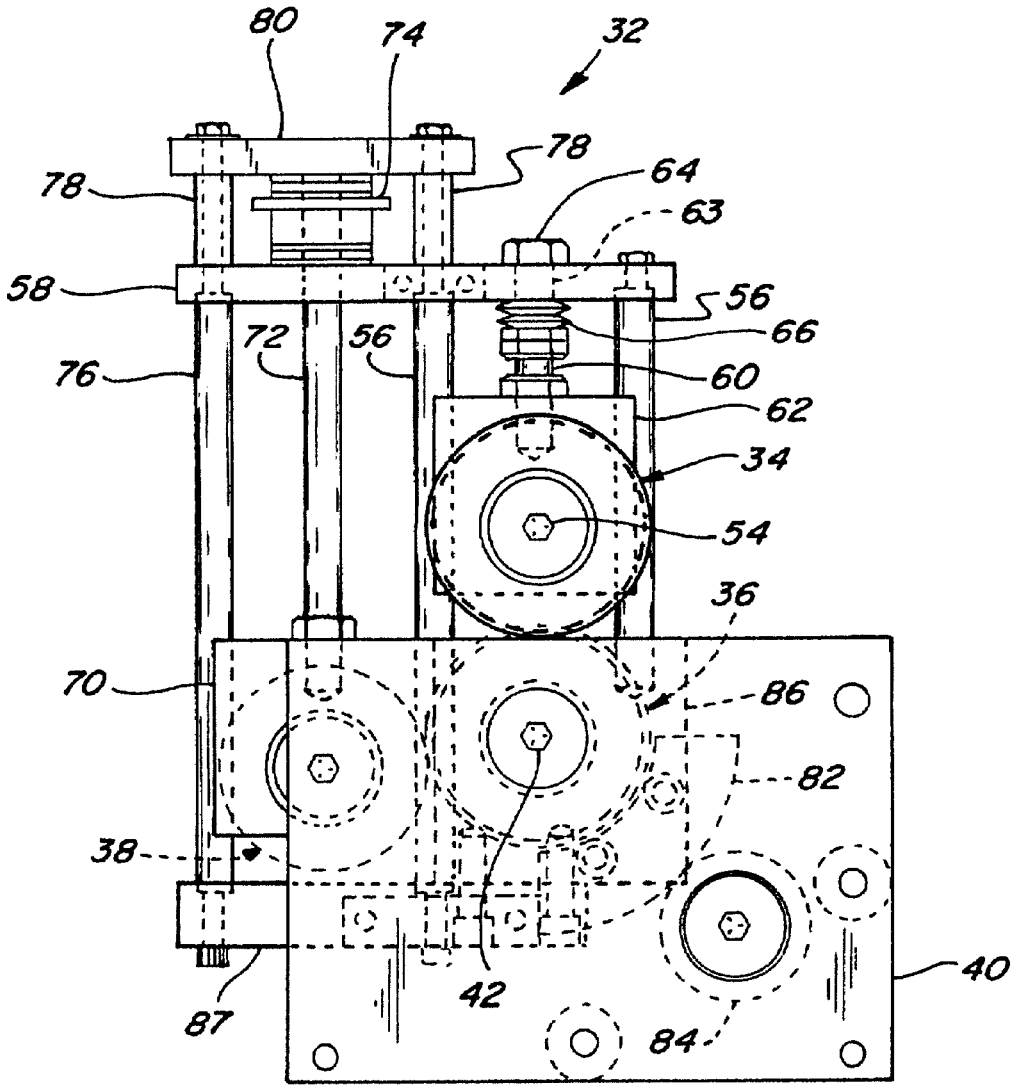
FIG. 4 is a side elevational view of the present head assembly showing the single straightening or idler roller.

Referring to FIGS. 3 and 4, there is shown one embodiment of an improved sheet metal coil straightener device 30 constructed according to the teachings of the present invention. The straightener device 30 includes a rotatable head assembly generally designated 32 (FIG. 4) which, among other things, includes a pair of entry feed or pinch rollers 34 and 36, a single straightening or idler leveling roller 38 (FIG. 4), and an appropriate support structure for operatively holding the rollers 34, 36 and 38 as will be hereinafter further explained. The lower feed or pinch roller 36 is rotatably coupled at each opposite end portion thereof to a pair of stationary mounting plates 40 and is rotatable about a shaft 41 having an axis of rotation 42 as best shown in FIG. 3. Appropriate journals and bearings 44 couple the lower feed or pinch roller 36 to the mounting plates 40 for rotation thereabout. The mounting plates 40 are likewise connected to an appropriate support frame structure such as the member 46 illustrated in FIG. 3, the members 40 and 46 forming at least a portion of a base frame assembly 47 (FIG. 3) to which the head assembly 32 is rotatably mounted. The lower pinch roller 36 is also appropriately coupled at each opposite end portion thereof to a pair of bearing block members 86 as will be hereinafter further explained. A conventional motor or other appropriate power source (not shown) is likewise coupled to shaft 41 at shaft end portion 50 for rotationally driving lower feed roller 36.

In similar fashion, the upper entry feed or pinch roller 34 is rotatably mounted at each opposite end portion to a pair of bearing block members 62 associated with head assembly 32 via appropriate journals and bearings 52 as best illustrated in FIG. 3. The upper feed or pinch roller 34 is likewise rotatable about a shaft 53 having an axis of rotation 54. The upper feed roller 34 is driven by the lower feed roller 36 via a conventional gearing arrangement such as the gear members 55 and 57. Rotation of feed or pinch rollers 34 and 36 feed the sheet metal material through the head assembly 32.

In order to accommodate different thickness of sheet material, the upper and/or lower pinch rollers 34 and 36 are adjustably moveable relative to each other in order to adjust and control the space therebetween. Although it is recognized and anticipated that either one or both of the rollers 34 and 36 may include adjustment mechanisms to selectively vary the space between such rollers, for exemplary purposes only, one embodiment of an adjustment mechanism for adjustably moving the upper pinch roller 34 relative to the lower pinch roller 36 is disclosed and described herein. This adjustment mechanism includes at least a pair of guide bar or post members 56 positioned adjacent each opposite end of the respective pinch rollers 34 and 36 as best illustrated in FIG. 4, the post members 56 being appropriately attached at one end portion thereof to a support member 58 as best illustrated in FIG. 3. A respective pair of threaded members 60 are threadedly secured at one end portion thereof to the respective pair of bearing block members 62, the members 62 being appropriately coupled to the upper pinch roller 34 as illustrated in FIGS. 3 and 4. The opposite end portion of each threaded member 60 passes through a corresponding opening 63 in support member 58 and is connected to a fastening member 64 such that rotation of the member 64 will correspondingly move the respective bearing block members 62 coupled to the upper pinch roller 34 in a vertical direction so as to selectively adjust the position of the upper pinch roller 34 relative to the position of the lower roller 36. This adjustment effects adjustment of the space between feed rollers 34 and 36. An appropriate spring member 66 such as the disc spring illustrated in FIG. 4 may be utilized to apply an appropriate biasing force to the upper pinch roller 34 as the sheet material is being fed between the entry rollers 34 and 36. This biasing force ensures appropriate tension is applied to the sheet material as it is being fed through the head assembly 32 so as to both ensure proper feeding through the head assembly 32 and to accommodate any variations in material thickness and/or other deformations associated therewith.

The present straightener device 30 likewise includes a single straightener or idler leveling roller 38 positioned adjacent to the entry feed rollers 34 and 36 as best illustrated in FIG. 4. The idler leveling roller 38 is similarly mounted through appropriate journals and bearings at each opposite end portion thereof to appropriate bearing cage members such as the member 70 illustrated in FIG. 4. The bearing cage members 70 are appropriately coupled or otherwise connected to the head assembly 32 for rotation therewith in a conventional manner.

Like the upper pinch roller 34, the idler leveling roller 38 is likewise adjustable relative to the pinch rollers 34 and 36, the idler roller 38 being moveable up and down in a vertical direction along a path of movement which is parallel to a line passing through the center of the respective axis of rotation 42 and 54 of the rollers 34 and 36 as illustrated and oriented in FIG. 4. This adjustment mechanism likewise includes a threaded rod or screw member 72 associated with each opposite end portion of idler roller 38, the threaded members 72 having one end portion thereof threadedly secured to a respective bearing cage member 70 and having their opposite end portion threadedly engaged with appropriate sprocket members 74 (FIGS. 3 and 4) such that rotation of the sprocket members 74 will correspondingly move respective bearing cage members 70 coupled to the idler roller 38 in a vertical direction parallel to the depiction of pinch rollers 34 and 36 illustrated in FIG. 4. Rotation of the sprocket members 74 selectively adjusts the position of the idler roller 38 relative to the pinch rollers 34 and 36. Adjustment of the idler roller 38 is necessary in order to achieve the proper exit orientation of the sheet material as it leaves head assembly 32 in route to other fabrication and/or machine operations as will be hereinafter explained depending upon whether the coiled sheet material is being over fed (overwound) or under fed (underwound) from a particular stock of coiled material. The sprocket members 74 are positioned, located and supported through the use of appropriate support members such as the support members 56, 58, 76, 78 and 80 illustrated in FIG. 4. The sprocket members 74 are driven via a chain member 68 and rotation of the sprocket members 74 can be accomplished through any conventional means such as through the use of appropriate motor or power means, or through the use of manual means such as a hand wheel or hand crank assembly. In the particular embodiment illustrated in FIG. 3, the chain member 68 is also routed around an idler sprocket member 75 and an idler sprocket crank assembly 77, the crank assembly 77 being adaptable for receiving a hand crank (not shown) or other appropriate manual crank mechanism such that rotation of the hand crank will selectively adjust the position of idler roller 38.

Figure 5:
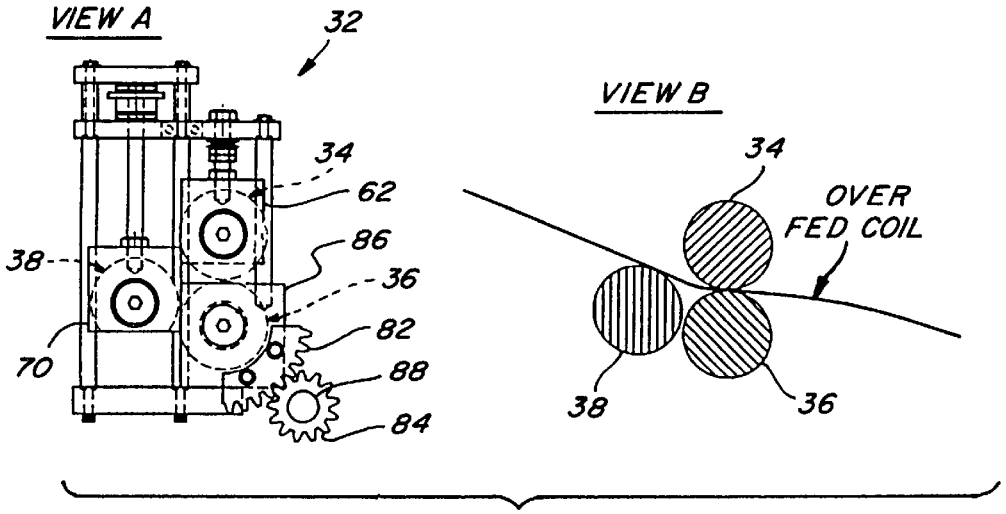
FIG. 5 is a combination drawing showing a side elevational view of the head assembly in view A configured for substantially removing the "coil set" associated with receiving sheet material from an overwound coil prior to rotation, and showing a cross-sectional view of the rollers in view B depicting the travel of the sheet material therebetween prior to rotation.
Figure 6:
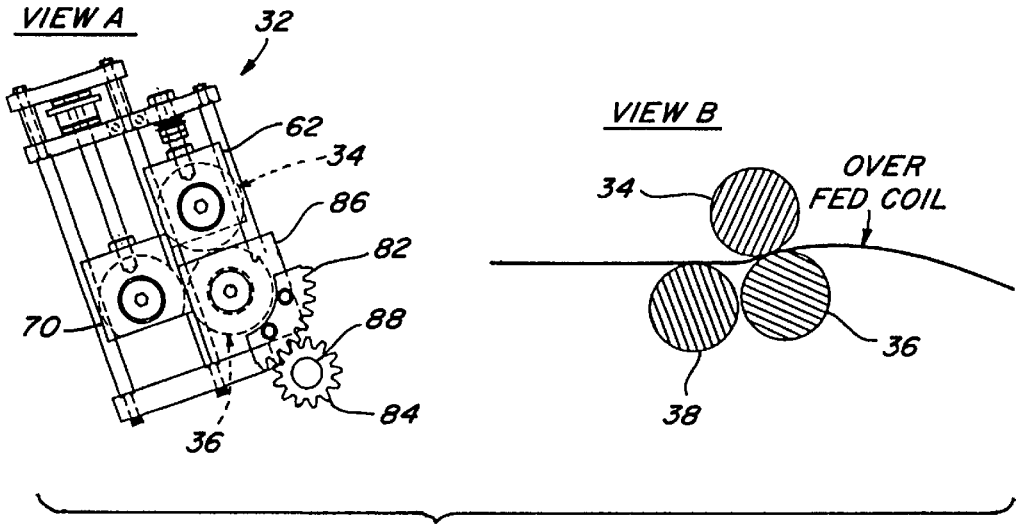
FIG. 6 is a combination drawing similar to FIG. 5 showing the head assembly of FIG. 5 after rotation in view A, and showing a cross-sectional view of the rollers in view B depicting the travel of the sheet material therebetween after rotation.
Figure 7:
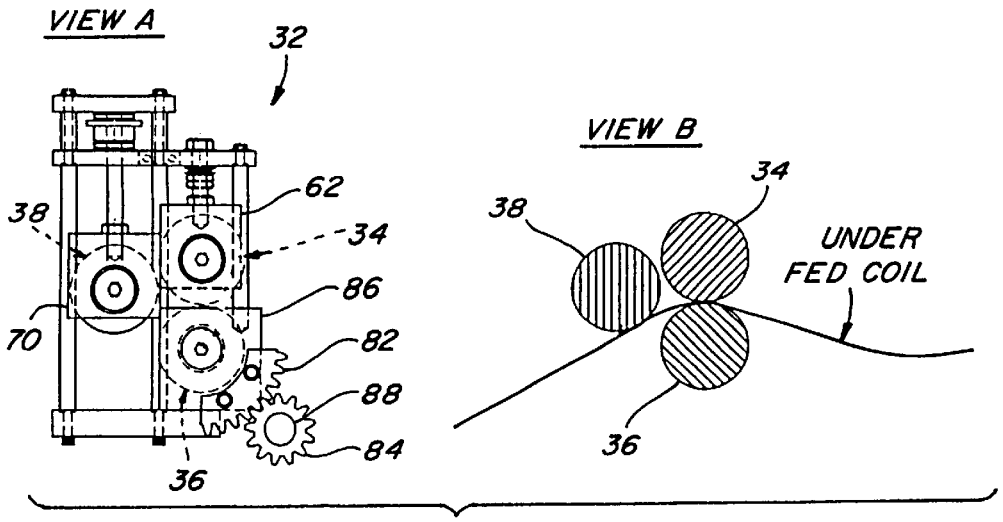
FIG. 7 is a combination drawing similar to FIG. 5 showing a side elevational view of the head assembly in view A configured for substantially removing the "coil set" associated with receiving sheet material from an underwound coil prior to rotation, and showing a cross-sectional view of the rollers in view B depicting the travel of the sheet material therebetween prior to rotation.
Figure 8:
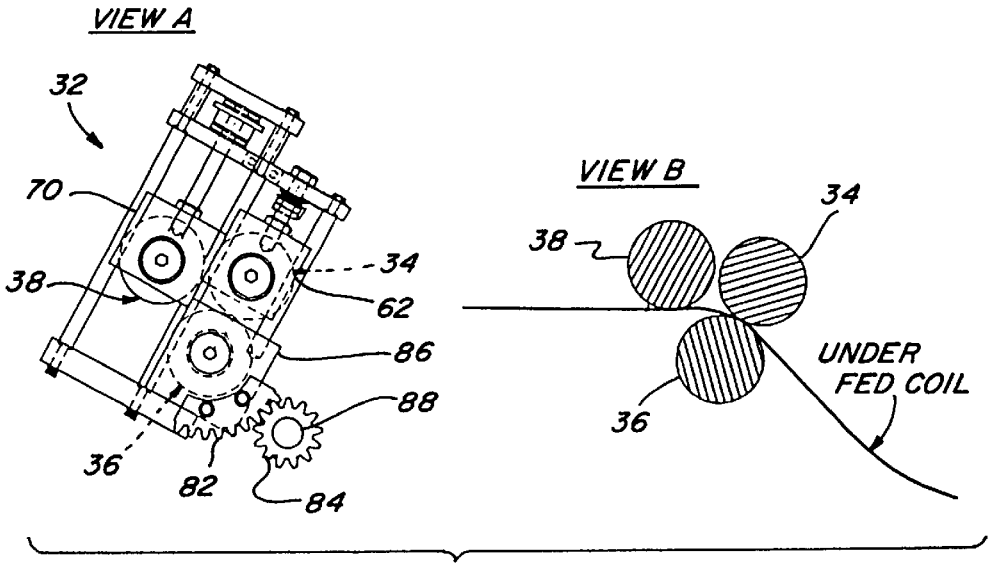
FIG. 8 is a drawing similar to FIG. 6 showing the head assembly of FIG. 7 after rotation in view A, and showing a cross-sectional view of the rollers in view B depicting the travel of the sheet material therebetween after rotation.

Rotation of the entire head assembly 32 is accomplished through the use of respective pairs of gear members 82 and 84 as illustrated in FIGS. 3–8. Gear members 82 are partial or quandrant gears as best illustrated in FIGS. 5–8 which are fixedly mounted to the lower bearing block members 86 associated with each opposite end portion of the lower pinch roller 36 as best illustrated in FIGS. 5–8. The bearing block members 86 are attached to the frame structure of the head assembly 32 such as to frame member 87 and the respective pairs of gear members 82 and 84 are positioned between the bearing block members 86 and the mounting plates 40 as best illustrated in FIG. 3. The lower bearing block members 86 rotate about the axis 42 of lower pinch member 36 as best illustrated in FIGS. 3, 6 and 8. The gear members 82 may be ring type gears or any other appropriate gear member compatible and engageable with the gear members 84.

The gear members 84 are fixedly mounted to the stationary mounting plates 40 as best illustrated in FIG. 3 and each gear member 84 is appropriately coupled to a positioning shaft member 88, rotation of shaft member 88 cooperatively rotating gear members 84. Shaft member 88 is rotatably mounted to the respective mounting plates 40 via appropriate journals and bearings as illustrated in FIG. 3. One end portion 90 of shaft member 88 extends through one of the mounting plates 40 (FIG. 3) and includes appropriate means for coupling a hand wheel or crank mechanism thereto for manually rotating shaft 88. As shaft member 88 is rotated, gear members 84 likewise rotate and the gear teeth associated with gear members 84 cooperatively engage corresponding teeth members associated with gear members 82. Since the gear members 82 are fixedly mounted to the bearing block members 86, rotation of gear members 82 will rotate the entire head assembly 32 in either a clockwise or counterclockwise direction as will be hereinafter further explained with respect to FIGS. 6 and 8. Once the gear members 84 are properly positioned via shaft member 88 to angularly orient the head assembly 32 at its proper orientation as will be hereinafter explained, an appropriate clamping or brake mechanism (not shown) associated with either the hand wheel mechanism or some other portion of the head assembly 32 or the straightener device 30 will lock and hold the shaft member 88 and head assembly 32 in their selected positions. Since the head assembly 32 including the rollers 34 and 38 can be rotated about lower pinch roller 36, as will be hereinafter explained with respect to FIGS. 6 and 8, the head assembly 32 can be selectively rotated to direct the direction of travel of the sheet material as it leaves the head assembly 32 as desired regardless of whether such coiled material is overfed or underfed into the head assembly 32.

Figure 1:
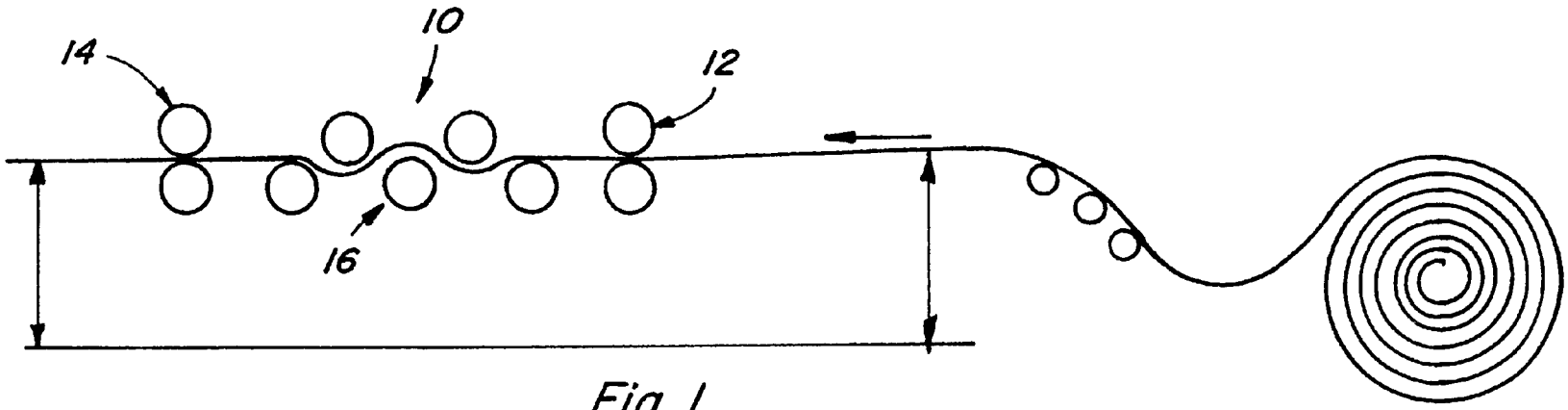
FIG. 1 is a schematic representation of a typical prior art sheet metal coil straightener device configured for accommodating overwound coils of sheet material.

FIGS. 5 and 6 illustrate the operation of the present rotatable head assembly 32 associated with receiving sheet material from an overwound or over fed coil of material, FIG. 5 showing the relationship of the various rollers 34, 36 and 38 prior to rotation of head assembly 32, while FIG. 6 shows the orientation of the rollers 34, 36 and 38 after proper rotation of head assembly 32. Referring to FIG. 5, head assembly 32 is positioned in a conventional upright orientation prior to any rotation thereof, and the respective rollers 34 and 38 are selectively adjusted via the adjustment mechanisms previously discussed so as to accommodate the particular thickness of the sheet material being over fed through the head assembly 32 and to substantially remove or eliminate the "coil set" associated with the over fed coil stock material. As best seen in view B of FIG. 5, the rollers 34 and 38 are properly adjusted relative to roller 36 so as to substantially remove or eliminate the prevalent "coil set" associated with the coiled stock of material as it is being fed into head assembly 32. As again illustrated in view B of FIG. 5, as the coil stock material exits the rollers 34, 36 and 38, the "coil set" associated with the over fed coiled material is substantially eliminated but, due to the orientation of the head assembly 32, the sheet material exiting head assembly 32 is now directed in an upward direction. This direction of travel of the sheet material as it exits head assembly 32 may be unacceptable for certain manufacturing and fabrication processes as the sheet material may not be properly oriented and aligned with compatible equipment for performing and accomplishing other fabricating and processing operations such as notching, hole punching, roll-forming, wing bending, conveying, stacking and/or shearing the material to length. For these types of fabricating operations, it is generally desirable to have the sheet material exit the straightener device in a substantially horizontal direction of travel parallel to the ground. In a conventional sheet metal coil straightener type device, the upward orientation of the sheet material as illustrated in view B of FIG. 5 would be corrected by passing the sheet material through a plurality of additional straightener or idler rollers such as the plurality of rollers 16 illustrated in FIG. 1. These additional rollers 16 would be positioned and oriented so as to ultimately substantially remove the "coil set" and allow the sheet material to exit the head assembly in a substantially horizontal direction parallel to the ground. With the present invention, the use of additional straightening rollers such as the plurality of rollers 16 illustrated in FIG. 1 is unnecessary as the head assembly 32 illustrated in FIG. 5 can be rotated such that the coiled material will exit head assembly 32 in a substantially horizontal direction parallel to the ground as illustrated in view B of FIG. 6. As illustrated in view A of FIG. 6, the head assembly 32 has been rotated in a counterclockwise direction to achieve the orientation of the rollers 34, 36 and 38 illustrated in view B of FIG. 6. Rotation of the present head assembly 32 as illustrated in FIGS. 5 and 6 therefore enables an operator to properly orient the pinch and idler rollers 34, 36 and 38 such that the sheet of coiled material, when overwound into head assembly 32, will exit the head assembly 32 in a proper orientation for entry into other fabricating and/or processing equipment associated with a particular manufacturing line whether that orientation is a substantially horizontal orientation parallel to the ground or any other desired orientation. In this regard, angular orientations other than orientations parallel to a horizontal plane may be desired, for example, if the sheet material is to be conveyed to other equipment located at a different elevation as compared to the straightener device 30.

FIGS. 7 and 8 illustrate the operation of the present head assembly 32 for removing the "coil set" associated with receiving sheet material from an under fed or underwound coil of material, FIG. 7 representing the position and location of the head assembly 32 and its associated rollers 34, 36 and 38 prior to rotation, and FIG. 8 representing the position and orientation of the head assembly 32 and its associated rollers after rotation of the head assembly 32. As previously explained with respect to FIG. 5, the rollers 34 and 38 are again selectively adjusted relative to the stationary pinch roller 36 so as to substantially remove any "coil set" associated with a particular stock of coiled material as such material is under fed or underwound from the coil stock into head assembly 32. As best illustrated in view B of FIG. 7, the "coil set" associated with an underwound coil is in a reverse direction as compared to the "coil set" illustrated in FIGS. 5 and 6 associated with an overwound stock of coiled material and, as a result, the position and location of idler roller 38 relative to pinch rollers 34 and 36 will be different as clearly seen from a comparison of the roller orientation illustrated in FIGS. 5 and 7. As clearly illustrated in view B of FIG. 7, since the "coil set" associated with an underwound coil is opposite to that associated with an overwound coil, the sheet of coiled material must be deflected in an opposite direction in order to substantially remove or eliminate such "coil set". As a result, if the head assembly 32 remains in a conventional substantially upright and vertical position as illustrated in FIG. 7, the sheet material exiting head assembly 32 will be directed downwardly as illustrated in view B of FIG. 7. Here again, although the "coil set" has been substantially eliminated from the underwound or under fed coil stock as such material exits head assembly 32, the downward orientation of the sheet material may again be unacceptable for certain fabricating and processing operations as previously explained. Here again, this downward orientation is typically corrected in a conventional straightener type device through the use of a plurality of additional idler or straightening rollers such as the rollers 16 illustrated in FIG. 2. As previously explained, the staggered positioning and location of the plurality of straightening rollers 16 illustrated in FIG. 2 will ultimately yield a substantially straight and horizontally flat piece of material which will exit the exit rollers 14 (FIG. 2) in a substantially horizontal direction parallel to the ground. In total contrast, however, use of the present rotatable head assembly 32 eliminates the need for using additional idler or straightening rollers 38 such as the plurality of rollers 16 illustrated in FIG. 2, and the proper orientation of the straightened sheet material as it exits head assembly 32 can be achieved by merely rotating head assembly 32 in a clockwise direction as illustrated in FIG. 8. Here again, head assembly 32 is rotated about the center axis 42 of the lower pinch roller 36 (view A of FIG. 8) such that the substantially straightened sheet material will exit head assembly 32 in a direction which is substantially parallel to the ground as illustrated in view B of FIG. 8. In all other respects, the operation of the present straightener device 30 as illustrated in FIGS. 7 and 8 will be substantially identical to the operation illustrated in FIGS. 5 and 6 except for the adjustment of idler roller 38 and the particular direction and amount of rotation of the head assembly 32. Rotation of the present head assembly 32 as illustrated in FIGS. 7 and 8 will enable an operator to properly orient the pinch and idler rollers such that the sheet of coiled material, when underwound into head assembly 32, will exit the head assembly in a substantially horizontal direction parallel to the ground, or any other desired orientation depending upon the subsequent fabricating processes to be accomplished. In this regard, the amount of angular rotation of head assembly 32 as illustrated in FIGS. 6 and 8 will also vary depending upon the thickness of the particular sheet material as well as the amount of "coil set" associated therewith.

Industrial Applicability

The present invention has particular utility in all applications where "coil set" or other types of deformation must be substantially removed from a particular sheet of material prior to performing other fabricating and manufacturing operations. Although the present rotatable head assembly 32 has been described with reference to substantially removing the "coil set" associated with receiving sheet material from an overwound or underwound coil of such material, it is recognized and anticipated that the present invention can likewise be utilized to remove other types of deformations associated with sheet material whether such material is stored in coil form or otherwise. In addition, it is also recognized and anticipated that the present rotatable head assembly 32 can be utilized to substantially remove the "coil set" or other deformations associated with materials other than sheet metal materials, such as a wide variety of different types of plastic and other composite type materials.

Figure 2:
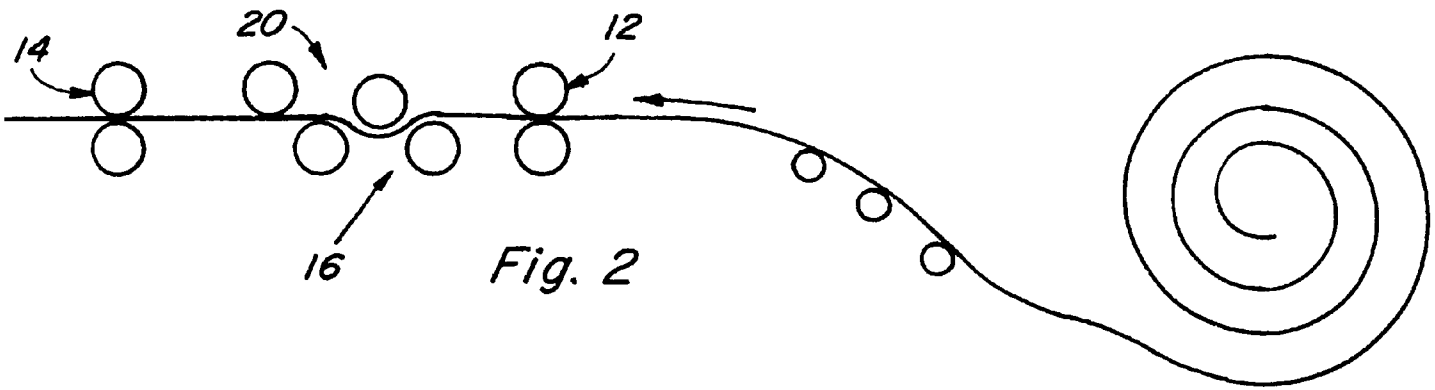
FIG. 2 is a schematic representation of a typical prior art sheet metal coil straightener device configured for accommodating underwound coils of sheet material.

It is also recognized and anticipated that although, in the preferred embodiment of the present head assembly 32 as best illustrated in FIGS. 4–8, only one straightener or idler roller 38 need be used in conjunction with the pair of entry feed or pinch rollers 34 and 36 in order to substantially eliminate the "coil set" associated with a particular stock of coiled material, additional idler rollers such as the roller 38 may likewise be incorporated into the rotatable head assembly 32 along the lines illustrated in FIGS. 1 and 2. These additional idler rollers may likewise be adjustable in accordance with adjustable mechanisms well known in the art, and it is further recognized that additional straightening or idler rollers may be positioned and located downstream from the rotatable head assembly 32 such that as the coil stock material exits head assembly 32, such material will be fed into these additional idler rollers for further straightening and other processing applications. In this regard, these additional straightening or idler rollers would be associated and coupled to other structural components associated with the overall straightener device 30.

Still further, it is also recognized that entry feed roller mechanisms other than the entry roller arrangement 34 and 36 illustrated herein may be utilized in association with the rotatable head assembly 32 and that one or both of such entry feed rollers 34 and 36 may be adjustable relative to each other. In this regard, it is anticipated that the feed rollers 34 and 36 may be configured and oriented in a manner other than the vertical arrangement illustrated in FIG. 4, and that the head assembly 32 may be rotatable about an axis of rotation other than the centerline axis 42 associated with the lower feed roller 36. For example, it is recognized that the head assembly 32 can be configured so as to be rotatable about the axis of rotation 54 associated with the upper feed roller 34, the axis of rotation associated with idler roller 38, or some other axis of rotation associated with head assembly 32. It is also recognized that a straightener device incorporating the rotatable head assembly 32 of the present invention may likewise include a pair of exit feed rollers similar to the exit feed rollers 14 illustrated in FIGS. 1 and 2. Like the entry feed rollers 34 and 36, one or both of any optional exit feed rollers utilized in conjunction with the present straightener device 30 could likewise be adjustable to accommodate the thickness of the particular sheet material passing therebetween.

In addition, since the preferred embodiment of the present head assembly 32 includes only one idler roller 38 as best illustrated in FIGS. 4–8, the sheet material can be fed into the head assembly 32 in a reverse direction from that illustrated in FIGS. 5–8 and the head assembly 32 can be appropriately rotated or tilted to achieve the desired direction of travel of the sheet material as such sheet material exits the head assembly 32 from the opposite direction. In this regard, it makes no difference whether the idler roller 38 is positioned fore or aft of the feed rollers 34 and 36 as the sheet material enters the rollers 34 and 36 since the rollers 34 and 38 can be adjustably positioned to substantially remove the "coil set" and the head assembly 32 can be rotated to achieve the desired direction of travel of the sheet material regardless of the direction of entry of such material into the head assembly 32.

Although the present head assembly 32 has been illustrated as being rotatable or tiltable about the base frame assembly 47 through the gear mechanism 82 and 84, it is recognized and anticipated that other rotational means may be utilized without departing from the spirit and scope of the present invention such as utilizing hydraulic and/or pneumatic means, other mechanical means such as through the use of a screw jack, electrical means, or any equivalents thereof. It is also recognized that the head assembly 32 can be rotatably mounted to a structure other than base frame assembly 47 or that base frame assembly 47 could itself be rotatably mounted to some other structure or housing without departing from the spirit and scope of the present invention. Other modifications, changes and variations of the rotatable feature of the present invention, including all equivalents thereof, are likewise contemplated.

Use of the present rotatable head assembly 32 therefore affords a user or operator distinct advantages over the known prior art straightener devices such as the devices 10 and 20 illustrated in FIG. 2. Not only does the present invention substantially reduce the number of straightening or idler rollers associated with a particular straightening device, which reduction substantially reduces the size, complexity and cost of the overall device, but the present head assembly 32 also, importantly, makes the straightener device more adaptable to accommodate over fed and under fed coil stock. In this regard, instead of individually adjusting a plurality of idler or straightening rollers such as the rollers 16 illustrated in FIGS. 1 and 2, an operator need only rotate the entire head assembly 32 as described above to achieve the correct orientation of the rollers 34, 36 and 38 as illustrated in FIGS. 5–8. The rotatable feature of the present invention also affords greater flexibility to an operator in that the operator can make minor tilting adjustments of the head assembly 32 to accommodate and/or correct for the thickness of the material and other fabricating or manufacturing parameters associated with a particular application.

Still further, since the total number of straightening or idler rollers typically associated with a conventional prior art straightener device has been substantially reduced, the power requirements for rotating the feed and idler rollers 34, 36 and 38 and for moving the sheet of material through and along such rollers to accomplish the straightening process is likewise substantially reduced. For example, in the prior art straightener device illustrated in FIG. 1, the power requirement for driving the entry feed rollers 12 and for moving the sheet material through the plurality of straightening rollers 16 and exit rollers 14 may be in the neighborhood of 3 horsepower. In comparison, the power requirement necessary to drive the entry feed rollers 12 and the plurality of straightening rollers 16 associated with the prior art construction illustrated in FIG. 2 may be in the neighborhood of 2 horsepower. In contrast, the power requirement necessary for driving the rollers 34, 36 and 38 associated with the present head assembly 32 will be in the neighborhood of 1 horsepower. Use of the present rotatable head assembly 32 therefore greatly reduces the power requirements for the straightening process and results in substantial energy savings over time. In addition, as explained above, use of the present head assembly improves the overall operation and efficiency of the straightening process.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims set forth below shall cover all such changes, modifications, variations and other uses and applications that do not depart from the spirit and scope of the present invention as descried herein.

Other aspects, objects and advantages of the present invention can be obtained from a study of the drawings, the disclosure and the appended claims.

What is claimed is:

1. A device for straightening sheet material comprising a base frame assembly and a head assembly rotatably mounted thereto, said head assembly including a pair of feed rollers and at least one idler roller, said pair of feed rollers being positioned relative to each other for receiving the sheet material therebetween, said idler roller being positioned adjacent said feed rollers so as to engage the sheet material as the sheet material passes between said feed rollers, said head assembly being rotatable about an axis of rotation such that the direction of travel of the sheet material as it exits said head assembly can be varied relative to a horizontal plane.

2. The device defined in claim 1 wherein at least one of said pair of feed rollers is moveable relative to said other feed roller so as to adjust the space therebetween.

3. The device defined in claim 1 wherein the position of said idler roller is adjustable relative to the position of at least one of said feed rollers.

4. The device defined in claim 3 wherein said idler roller is adjustable along a path which is parallel to a line passing through the center of each of said feed rollers.

5. The device defined in claim 1 wherein the axis of rotation of said head assembly is coincident with the axis of rotation of one of said feed rollers.

6. The device defined in claim 1 including biasing means for urging one of said feed rollers towards the other feed roller.

7. The device defined in claim 1 wherein said head assembly is rotatable about said axis of rotation by a gear mechanism.

8. The device defined in claim 7 wherein said gear mechanism is selectively operable to rotate said head assembly such that the direction of travel of the sheet material as it exits said head assembly will be substantially parallel to a horizontal plane.

9. The device defined in claim 1 including power means for driving at least one of said feed rollers.

10. A device for removing the coil set from a sheet of coiled material comprising a base frame assembly and a head assembly rotatably mounted thereto, said head assembly including a pair of feed rollers and an idler roller, said pair of feed rollers being positioned relative to each other for receiving the sheet material therebetween, at least one of said feed rollers being selectively adjustable relative to said other feed roller so as to vary the space therebetween, said idler roller being located adjacent said feed rollers and being selectively positionable relative thereto, said head assembly being rotatable about an axis of rotation such that the direction of travel of the straightened sheet material as it exits said head assembly will be substantially parallel to a horizontal surface.

11. The device defined in claim 10 wherein the axis of rotation of said head assembly is coincident with the axis of rotation of one of said feed rollers.

12. The device defined in claim 11 wherein the at least one adjustable feed roller includes biasing means for urging said at least one feed roller towards the other feed roller.

13. The device defined in claim 10 wherein said head assembly includes gear means for rotatably moving the head assembly relative to said base frame assembly.

14. The device defined in claim 13 wherein said gear means includes at least one gear member associated with said head assembly and at least one gear member associated with said base frame assembly.

15. The device defined in claim 13 wherein said head assembly is rotatable in both a clockwise and a counterclockwise direction.

16. The device as defined in claim 10 including means for rotatably driving at least one of said feed rollers.

17. In a device for straightening sheet material having a frame structure associated therewith for supporting a mechanism including at least two rollers between which the sheet material passes for straightening the sheet material, the improvement comprising a head assembly for holding at least a portion of the mechanism including said at least two rollers for straightening the sheet material, said head assembly being rotatably mounted to the frame structure and being rotatable about an axis of rotation such that the direction of travel of the straightened sheet material as it exits said head assembly can be angularly varied relative to a horizontal plane.

18. The improvement defined in claim 17 wherein said at least two rollers includes a pair of feed rollers and at least one idle roller.

19. The improvement defined in claim 17 wherein said head assembly is rotatable such that the direction of travel of the sheet material as it exits said head assembly will be substantially parallel to a horizonal plane.

20. In a device for straightening sheet material having a frame structure associated therewith for supporting a mechanism for straightening the sheet material, the improvement comprising a head assembly rotatably mounted to the frame structure, said head assembly including a pair of feed rollers and at least one idler roller, said head assembly being rotatable about an axis of rotation such that the direction of travel of the straightened sheet material as it exits said head assembly will be substantially parallel to a horizontal plane.

21. The improvement defined in claim 20 wherein at least one of said pair of feed rollers is moveable relative to said other feed roller so as to adjust the space therebetween.

22. The improvement defined in claim 20 wherein the position of said at least one idler roller is adjustable relative to said pair of feed rollers.

23. The improvement defined in claim 20 wherein said at least one idler roller is adjustable along a path which is parallel to a line passing through the center of each of said feed rollers.

24. The improvement defined in claim 20 wherein the axis of rotation of said head assembly is coincident with the axis of rotation of one of said feed rollers.

25. The improvement defined in claim 20 including biasing means for urging one of said feed rollers towards the other feed roller.

* * * * *